US005287043A

United States Patent [19]

Brag

[11] Patent Number: 5,287,043

[45] Date of Patent: Feb. 15, 1994

[54] APPARATUS FOR AUTOMATICALLY GENERATING A CORRECT CRT DISPLAY REGARDLESS OF TIMING SIGNALS

[76] Inventor: Johan O. Brag, 1101 Green St., San Francisco, Calif. 94109

[21] Appl. No.: 803,655

[22] Filed: Nov. 26, 1991

Related U.S. Application Data

[63] Continuation of Ser. No. 402,843, Sep. 5, 1989, abandoned, which is a continuation of Ser. No. 175,767, Mar. 31, 1988, abandoned.

[51] Int. Cl.[5] ..... G09G 1/04; H01J 29/56

[52] U.S. Cl. ..... 315/371; 315/403

[58] Field of Search ..... 315/370, 371, 403, 405

[56] References Cited

U.S. PATENT DOCUMENTS

| | | | |
|---|---|---|---|
| 2,449,969 | 9/1948 | Wright | 315/405 |
| 2,503,745 | 4/1950 | Kerkhof | 315/405 |
| 2,900,565 | 8/1959 | Moore | 315/405 |
| 3,153,174 | 10/1964 | Claypool et al. | 315/405 |
| 4,334,173 | 6/1982 | Gabriel et al. | 315/399 |
| 4,501,995 | 2/1985 | Olmstead et al. | 315/371 |
| 4,645,985 | 2/1987 | Dietz | 315/371 |
| 4,652,798 | 3/1987 | Lester et al. | 315/371 |
| 4,829,414 | 5/1989 | Yook | 315/408 |

FOREIGN PATENT DOCUMENTS

| | | | |
|---|---|---|---|
| 736005 | 8/1955 | United Kingdom | 315/405 |

*Primary Examiner*—Gregory C. Issing

*Attorney, Agent, or Firm*—Heller, Ehrman, White & McAuliffe

[57] ABSTRACT

Apparatus and method for generating a correct CRT display suitable for photographing without adjustment, regardless of horizontal and vertical timing signals. Sawtooth current waveforms of constant maximum amplitude and "S" bending are generated through the horizontal and vertical windings of the deflection coils for the CRT display in order to produce a scan of constant width, height, and horizontal and vertical linearity.

8 Claims, 11 Drawing Sheets

VERTICAL DEFLECTION SYSTEM

HORIZONTAL DEFLECTION SYSTEM

VERTICAL TIMING
EFFECT ON LINEARITY

RIGHT SIDE
COMPRESSION

RIGHT SIDE
STRETCH

APPARATUS FOR AUTOMATICALLY GENERATING A CORRECT CRT DISPLAY REGARDLESS OF TIMING SIGNALS

This is a continuation of application Ser. No. 07/402,843 now filed Sep. 5, 1989, which is a continuation of application Ser. No. 07/175,767 filed Mar. 31, 1988, now abandoned.

BACKGROUND OF THE INVENTION

For image processing and color graphic applications which require an accurate hardcopy reproduction, photographic media represents the best alternative because of its high resolution, wide dynamic range and color sensitivity.

Several methods may be used to obtain a photographic hardcopy. One method is to use a 35 mm camera on a tripod to take pictures directly off the display monitor. Such a method has several disadvantages: first, geometric distortion would result from the curvature of the screen being photographed; second, imperfect registration of the red, green and blue beams hitting the cathode ray tube phosphor results in loss of contrast and sharpness; also, lack of compensation for the non-linear aspects of film saturation relative to exposure time results in shifts in color and gray levels from the original image. For these and other reasons, a film recorder is required if consistent and artifact free reproductions are to be created.

An example of a film recording system of general applicability for the conversion of video data to photographic hardcopy is provided by a system designed by Focus Graphics Corporation of Redwood City, Calif. These systems operate by sequentially generating three different images, one for each color on the photographic medium, on a precision monochrome CRT. For each color image a different color filter matched to the corresponding film color is interposed between the CRT and the film. The image is recorded under control of the microprocessor, which determines the exposure time and light intensity variations during each image scan. These systems will hereafter be referred to as Computer Image Recorders or CIR.

Because of the rapid development pace in the computer graphics and image processing field, new video generating systems are constantly being introduced which are capable of higher and higher resolutions. Different video resolutions translate into different timing signal characteristics. The horizontal sync frequency in particular will change as the video resolution changes. One very desirable feature for a raster scan system is the ability to be compatible with a broad range of horizontal sync frequencies, and therefore to be compatible with a wide range of video sources. This capability is generally known and will hereafter be referred as multiscan capability.

Various workers in the art have resolved this problem with various degrees of success. A number of systems are known for generating color and pseudo-color displays from input video signals presented in raster scan format. Some of these systems such as the NEC multi-sync monitor are capable of handling a wide variety of video signals, in particular a broad range of incoming horizontal frequencies.

A number of factors have precluded the development of multiscan systems able to produce an accurate conversion to photographic records. It need only be noted that width and height of the image will vary with the horizontal and vertical scan frequencies, affecting the size of the photographic record.

Automatic conversion of the information contained in video signals to a photographic image also requires compensation for changes in horizontal and vertical linearity and should desirably be able to convert video signals with different sync polarities or signals including equalizing and serration pulses.

The techniques used heretofore to handle video signals with different timing signals have relied on phase-lock loop circuits to attempt to achieve multiscan capability. While such techniques can be utilized to convert video signals within a narrow range of horizontal frequencies, they have proved inadequate to satisfy current needs. As a consequence, manufacturers of CIR systems offer a family of systems, each optimized for a certain range of timing signals. At most variations of 5 to 10% of horizontal frequencies have been introduced using conventional phase-lock techniques. In addition, even small variations of horizontal and vertical frequency require lengthy and complicated tuning procedures as width, height, horizontal and vertical linearity of the picture will be affected.

More recently manufacturers of video display terminals have introduced multiscan displays able of covering a two to one range in frequencies by breaking down the overall range into three smaller ranges and electronically selecting the range depending on the video signal. Within each smaller range, the unit is then synchronized using traditional phase-locked loop techniques. Such a technique will exhibit focal points in scan frequencies at which the unit synchronizes satisfactorily. Outside of these focal points the units will generally require some manual adjustments in order to provide adequate synchronization. As a consequence such displays fail to provide consistent width and horizontal linearity making them unsuitable for photographic applications.

Another limitation of existing raster scan systems is their limited vertical sync range. While some will synchronize within a relatively broad range, they will fail to maintain consistent vertical linearity.

Prior art approaches can therefore be seen to be unsuitable for handling the full scope of horizontal and vertical sync frequencies current computer systems can generate in a manner suitable for photographic reproduction, without significant manual adjustments. They also have limited capability for handling video signals with varying video levels, sync polarities and other types of video characteristics.

SUMMARY OF THE INVENTION

An object of the present invention is to generate a correct raster scan display suitable for photographing regardless of horizontal and vertical timing signals.

A more specific object of the invention is to generate a raster scan display of constant height, width, vertical and horizontal linearity regardless of video timing signals.

This is accomplished in the current invention by horizontal and vertical deflection circuits that provide controls that are automatically compensated and require no user interaction.

The vertical deflection system is designed to provide a raster of constant height and vertical linearity. The resultant is an "S" shaped current ramp of both constant amplitude and "S" bending regardless of vertical timing.

In a preferred embodiment of the invention, an integrating circuit generates a linear voltage ramp. A variable gain device will then adjust the peak voltage to equal a reference voltage. Before this voltage waveform is presented to the vertical deflection coil it is necessary to compress the waveform to compensate for the flat face cathode ray tube scan. That is, the rate of voltage change needs to gradually be reduced at both the start and end of each scan. With crossover occurring at center of the ramp (½* +R) no compensation is required at that point. A method for producing a linearity compensated ramp is to determine the amount of ramp voltage difference from center and use this voltage to modulate the original waveform to the desired "S" characteristic waveform. One example is to provide a first approximation of the correction required via an absolute value circuit and use a multiplier circuit to modulate the original waveform by the first approximation correction.

It is also necessary to adjust the "B+" voltage supplied to the horizontal output transformer proportionately to the true horizontal sync repetition rate for purposes of maintaining CRT display scan width. An increase in horizontal frequency will create a compression of the scan on both sides.

Existing approaches to this problem have revolved around detecting and maintaining peak deflection currents as these remain constant independently of horizontal sync frequencies. This approach is more suitable to compensate for supply voltage variations than for large horizontal frequency variations that require proportional B+ voltage changes.

In a preferred embodiment of the invention, the horizontal trigger signal is supplied to a frequency to voltage converter. The output voltage is then used to control the voltage regulator to generate the B+ voltage supplying the horizontal output transformer.

A traditional horizontal deflection system will employ both a linearity coil and an "S" capacitor. The capacitor serves two functions- it removes the D.C. component of the horizontal output transistor and also serves to control the "S" bending at the right edge of the scan and therefore to adjust the linearity at the right edge of the image. The linearity coil is a magnetically biased inductor whose impedance varies with the current going through it thereby controlling the "S" bending or linearity at the left edge of the image. The width and linearity of systems using such deflection system are very frequency dependent.

The horizontal deflection system part of the invention is different by its absence of an "S" capacitor for linearity compensation. Instead it provides an isolated secondary winding on the horizontal output transformer, thereby removing the need for a capacitor to remove the D.C. component. The linearity is adjusted through a bipolar linearity coil whose impedance varies in accordance to the current independently of current polarity. Because of the strictly inductive nature of the deflection circuit, the impedance to frequency ratio is maintained constant and therefore the "S" bending of the current waveform is not affected.

DESCRIPTION OF THE FIGURES

FIG. 1A-2 shows waveforms associated with the circuit of FIG. 1A-1.

FIG. 1B-1 details the vertical linearity correction circuit portion of the vertical deflection system part of the invention.

FIG. 1B-2 shows waveforms associated with the circuit of FIG. 1B-1.

FIG. 1C-1 details the multiplier circuit portion of the vertical deflection system part of the invention.

FIG. 1C-2 shows waveforms associated with the circuit of FIG. 1C-1.

FIG. 2A-1 details the horizontal sync detector portion of the horizontal deflection system part of the invention.

FIG. 2A-2 shows waveforms associated with the circuit of FIG. 2A-1.

FIG. 2C-1 details the horizontal linearity correction circuit portion of the horizontal deflection system part of the invention.

FIG. 2C-2 shows waveforms associated with the circuit of FIG. 2C-1.

DETAILED DESCRIPTION OF THE INVENTION

Figure 3:
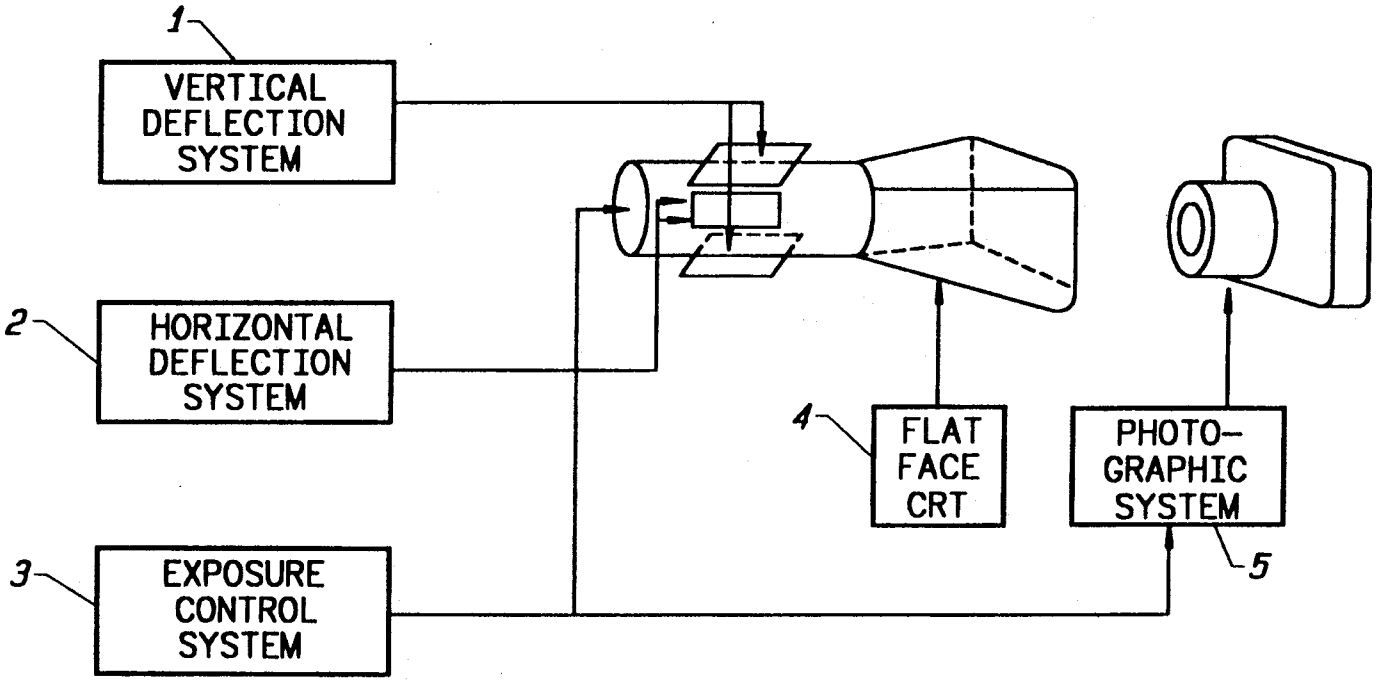
FIG. 3 is a simplified perspective view of a system for generating pictures on a flat face CRT suitable for photographing.

A system in accordance with the invention, referring to FIG. 3, may be utilized to generate photographic images from a video source such as a data processing display. A vertical deflection system 1 and a horizontal deflection system 2 operating in synchronism with vertical and horizontal timing signals, control the position of the electron beam striking the face of a flat face CRT 4. An exposure control circuit 3 controls whether the beam is on or off and the operation of the photographic system 5 shutter and film advance. Details of such an exposure control circuit have been omitted for brevity as they are not relevant to this invention.

Figure 4:
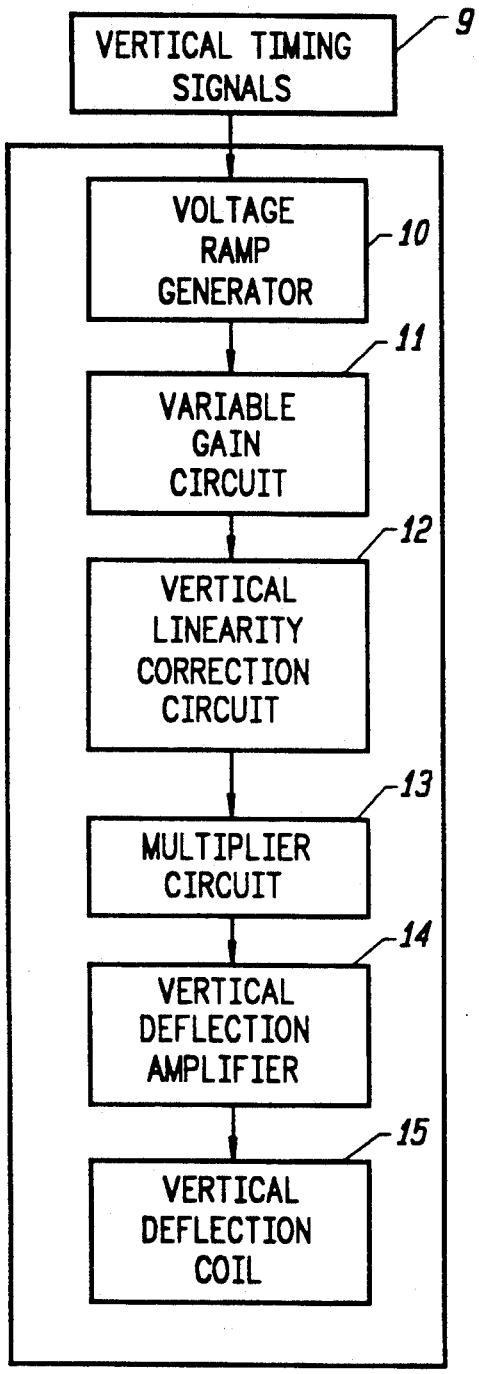
FIG. 4 shows the functional relationships among the circuit elements of the vertical deflection system.

FIG. 4 shows the functional relationship among the various circuit elements of a vertical deflection circuit according to the invention. A voltage ramp generator circuit 10 creates a sawtooth voltage waveform with a frequency equal to the vertical repetition rate extracted from the vertical timing signals 9. A variable gain circuit 11 adjusts the peak amplitude to equal a reference voltage. A vertical linearity correction circuit 12 generates a waveform that compensates for the varying distance between the center of deflection and the faceplate of the CRT. A multiplier circuit 13 supplies the linearity corrected voltage waveform to the vertical deflection amplifier 14 producing the power necessary to provide vertical deflection of the picture tube beam by the vertical deflection coils 15.

Figures 1, 1A:
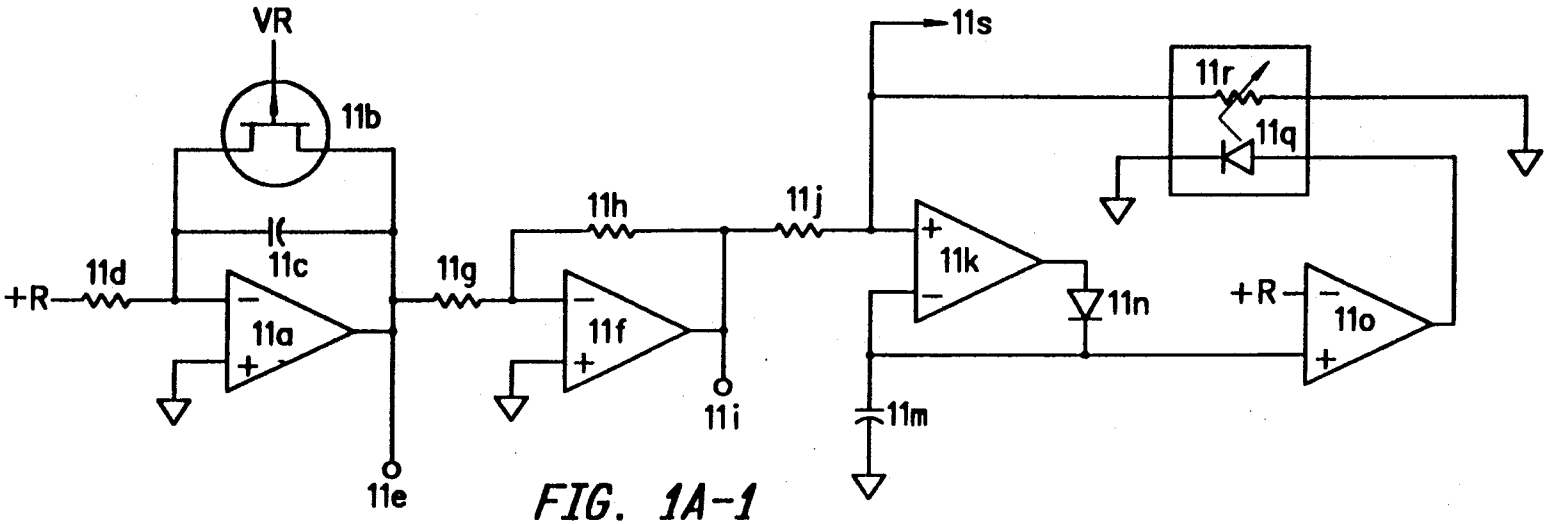
FIG. 1A-1 details the voltage ramp generator and variable gain circuit portions of the vertical deflection system part of the invention.
Figures 1, 1A, 2:
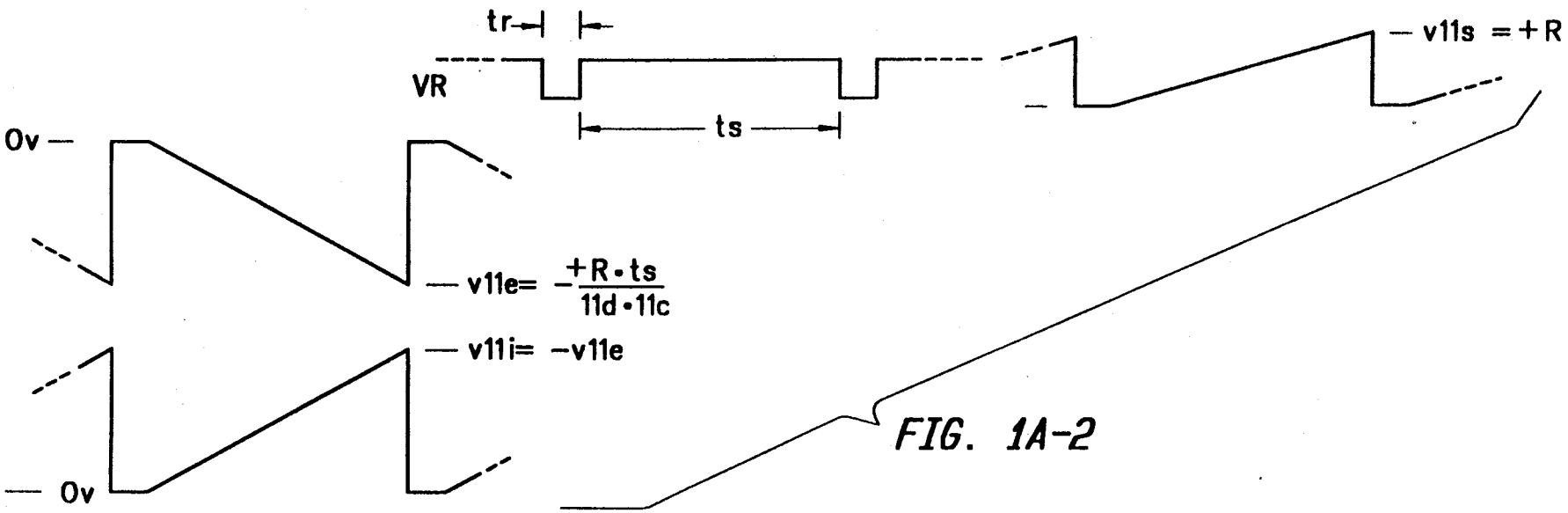

Existing implementations of vertical deflection integrator circuits generate voltage waveforms with a peak amplitude varying with the vertical sync repetition rate. Use of single chip vertical deflection processors preset for a narrow range of vertical sync rates also precludes operation at very low frequencies (below 30 Hz). Referring now to FIGS. 1A-1 and 1A-2, the current invention includes an electronic circuit that creates a voltage ramp of constant peak voltage regardless of vertical timing signals. Integrator consisting of amplifier 11*a*, fet switch 11*b*, capacitor 11*c* and resistor 11*d* generate a negative going voltage ramp at 11*e* from reference voltage +R. Fet switch 11*b* resets the ramp to zero at every vertical sync pulse VR. This ramp is then input into inverter consisting of amplifier 11*f* and equal resistors 11*g* and 11*h*, where the ramp is inverted to be positive going at 11*i*. Amplifier 11*f* drives a variable voltage divider network made up of resistors 11*j* and 11*r*. The output of the voltage divider network is then supplied to peak detector consisting of amplifier 11*k*, capacitor 11*m* and diode 11*n*. The peak voltage of ramp at 11*i* will vary depending upon the vertical frequency rate. The greater the vertical frequency the less the peak voltage. The output peak voltage is stored at capacitor 11*m*. This peak voltage is supplied to error amplifier 11*o*. The peak voltage is compared by 11*o* against a reference voltage +R. The amplifier 11*o* drives a variable gain device (such as the LED 11*q* and photoresistor 11*r*) adjusting the variable resistance 11*r* until the peak voltage equals the reference voltage +R. The result is a stabilized ramp at 11*s* of constant peak amplitude regardless of vertical sync frequency.

Figure 5:
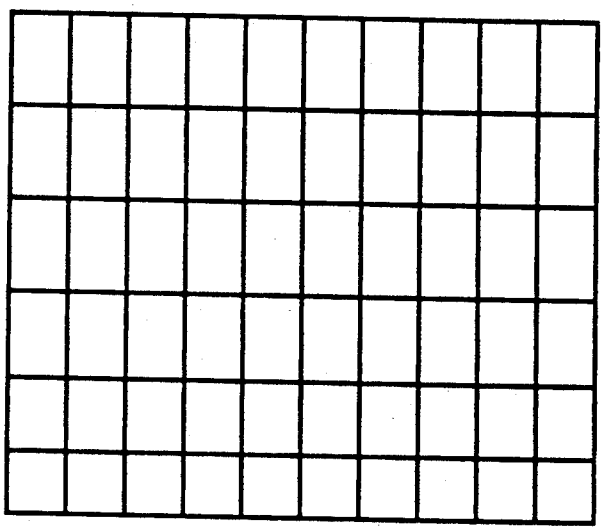
FIG. 5 shows the effect of variations in the repetition rate of the vertical sync pulses on vertical linearity.

In traditional vertical deflection systems, linearity correction is provided via a positive feedback waveform added to the linear voltage ramp. The shape of the feedback waveform in such systems will vary with the repetition rate of the vertical sync pulses, requiring manual adjustment of linearity. A typical effect of the variation of the repetition rate of vertical sync pulses on vertical linearity is shown in FIG. 5. A linear grid displayed on the flat face CRT 4 will show vertical distortion as the vertical timing signals vary.

Figures 1, 1B:
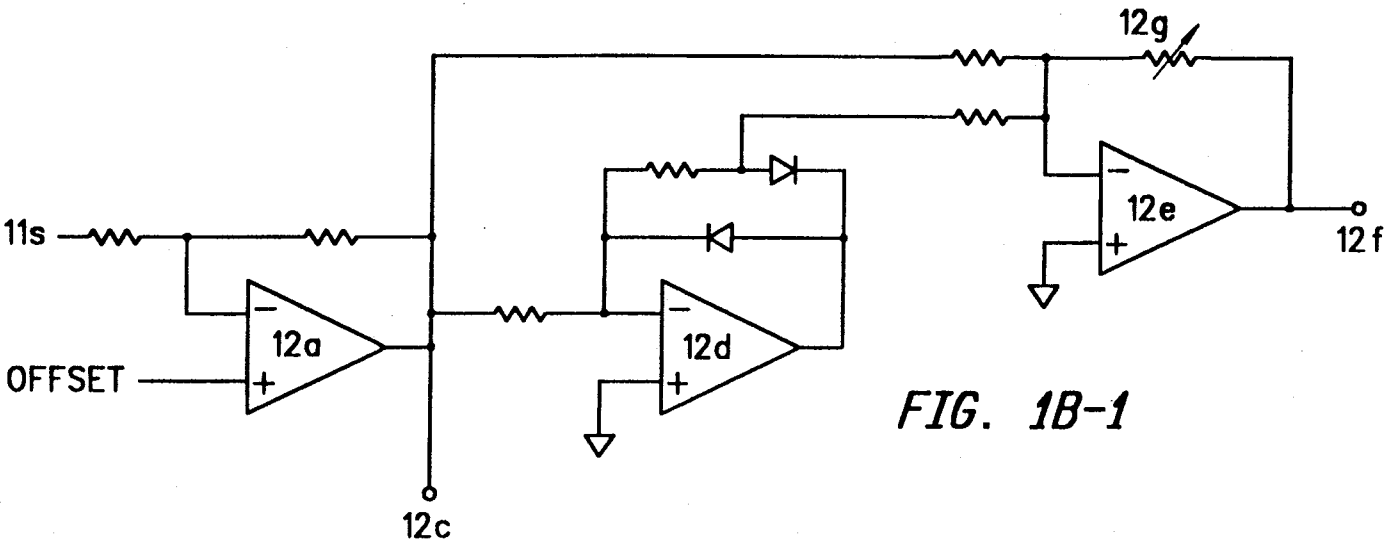
Figures 1, 1B, 2:
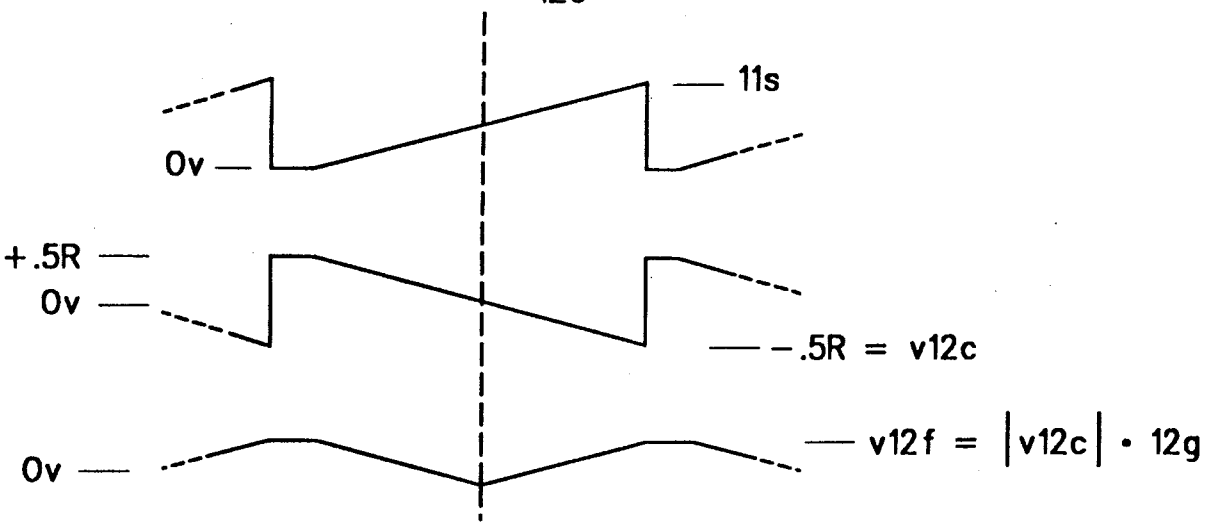

In the current invention, a preferred embodiment of the linearity correction circuit is detailed in FIG. 1B-1, and the associated waveforms are shown in FIG. 1B-2. The circuit generates a first order approximation of the correction required to deflect a beam across a flat face CRT. Amplifier 12*a* offsets and inverts voltage stabilized ramp 11*s* generated by circuit 11 so that the output ramp at 12*c* is bipolar (centered at ground). An absolute value circuit consisting of amplifiers 12*d*, 12*e* and related components create a positive voltage (regardless of polarity) at 12*f*, proportional to the amplitude of the bipolar ramp with respect to ground (scan center). The amplitude of the voltage may be varied by adjusting variable resistor 12*g*. A unique feature of the correction waveform at 12*f* is that it will track any variations in the slope of the linear bipolar ramp at 12*c* due to variations of the repetition rate of the vertical sync pulses.

Figures 1, 1C:
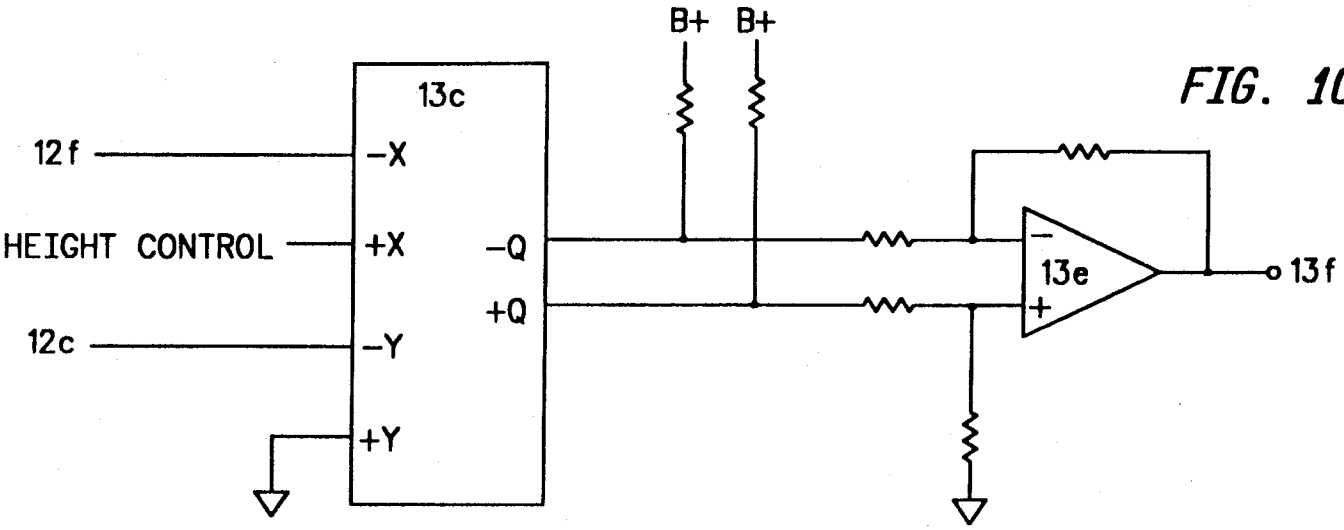
Figures 1, 1C, 2:
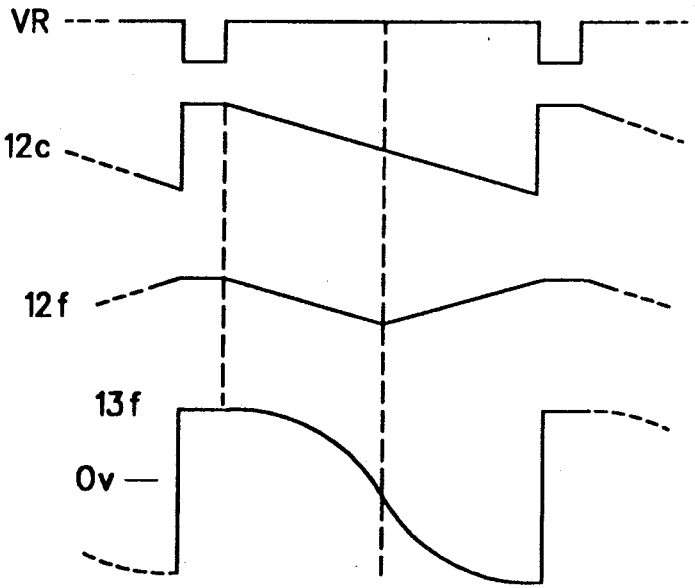

FIG. 1C-1 details detailing the relevant portions of the vertical deflection driver circuit part of the invention. The associated waveforms are shown in FIG. 1C-2. The compression of waveform 12*c* is generated by modulating waveform 12*c* by waveform 12*f* by a four quadrant multiplier (an integrated circuit) 13*c*, and associated circuitry. The Multiplier 13*c* has differential inputs. The waveform 12*c* is admitted to the inverting Y input. The non-inverting Y input is referenced to ground so that the output will retain its bipolar waveform. The multiplicand (X inputs) are a constant voltage admitted to the non-inverting X input and differentially reduced by the amount of waveform at 12*f*. The product (Q outputs) of 13*c* is level shifted by amplifier 13*e* and associated components. The output at 13*f* is a waveform of constant peak amplitude and constant linearity compression regardless of vertical timing signals. The waveform 13*f* is presented to any linear vertical deflection amplifier not represented for sake of brevity.

Figure 6:
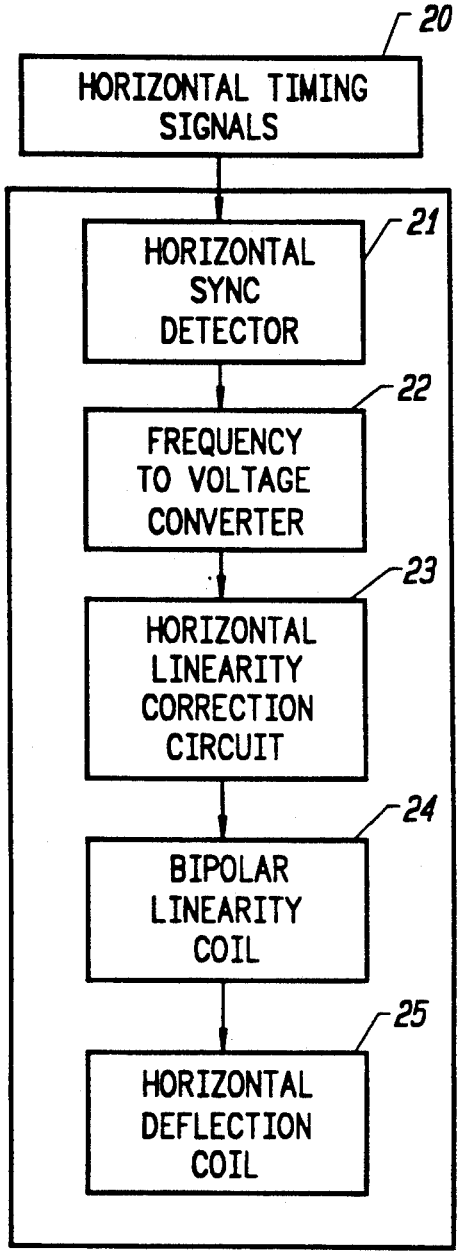
FIG. 6 shows the functional relationships among the circuit elements of a horizontal deflection system.

FIG. 6 shows the functional relationship among the various circuit elements of a horizontal deflection circuit according to the invention. The horizontal sync detector circuit 21 will be synchronized with the leading edge of the horizontal sync pulses extracted from the horizontal sync pulses. The frequency to voltage circuit 22 produces the "B+" voltage applied to the horizontal output transformer. The horizontal linearity correction circuit 23 produces the sawtooth current waveform of constant "S" bending passing through the bipolar linearity coil 24 and horizontal deflection coils 25. Only the relevant portions of the horizontal deflection circuit part of the invention will be detailed for sake of brevity.

In a traditional horizontal oscillator circuit, a horizontal processing chip will handle the synchronization with the horizontal sync pulses using a phase lock loop approach. Such a circuit will only synchronize within a very limited range of horizontal frequencies requiring manual adjustment of the horizontal hold control outside that limited range.

Figures 1, 2A:
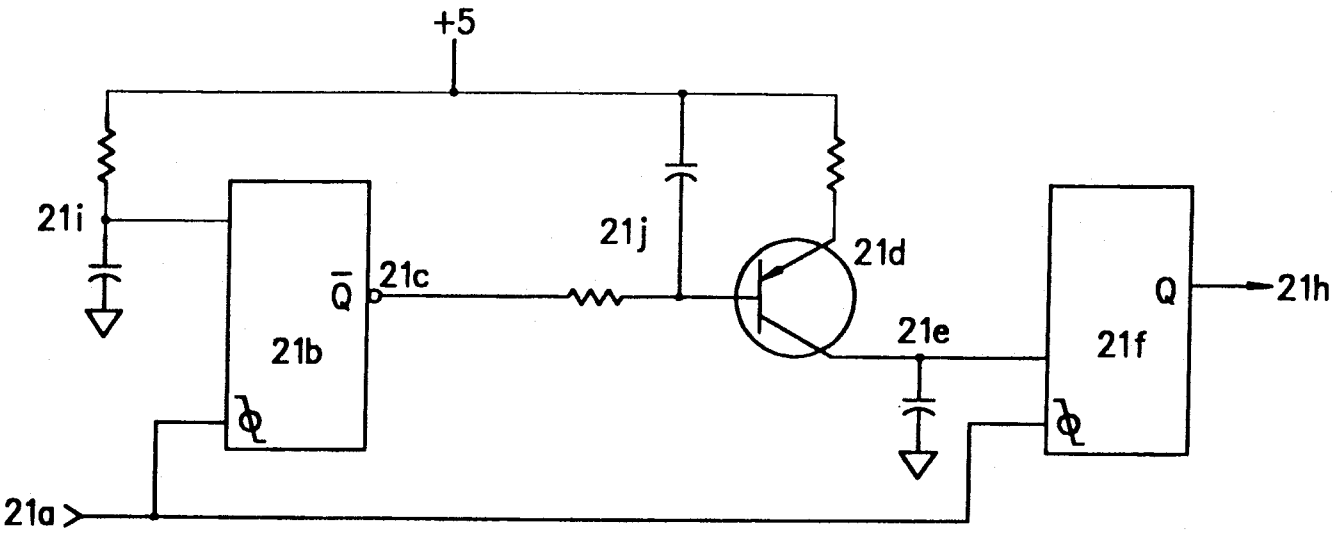
Figures 2, 2A:
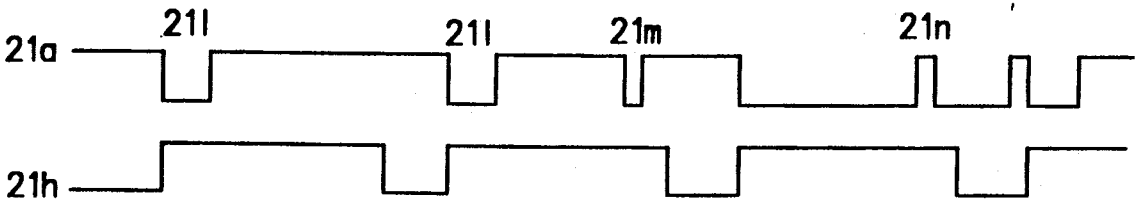

The horizontal oscillator circuit of FIG. 2A-1 is designed to synchronize the horizontal deflection circuit within a very broad range of timing signals. The waveforms associated with FIG. 2A-1 are shown in FIG. 2A-2. It detects the leading edge of the horizontal sync pulse 21*l* and filters out the serration 21*n* and equalizing 21*m* pulses from a composite sync signal of undetermined horizontal frequency. It consists of two non-retriggerable monostable multi-vibrator devices (also called one-shot devices). The circuit action is a negative going composite sync signal 21*a* triggers monostable multi-vibrator 21*b* for a period determined by timing components 21*i*. The resultant pulse train is averaged by low pass filter 21*j*. The average voltage is converted to a current value 21*e* by action of transistor 21*d* and resistor 21*k*. This current in turn modulates the output pulse width of second multi-vibrator 21*f*. The period of 21*f* is chosen and maintained at approximately 65% of the incoming true horizontal period. The result produces a system trigger pulse 21*h* whose onset is in constant phase relation to the onset of incoming true horizontal sync pulses regardless of any equalizing and serration pulses.

Traditional implementations of horizontal driver stages make no attempt at automatically controlling the width of the scan within a broad range of horizontal timing signals. Current approaches to width regulation of the image have generally included a circuit that senses the horizontal deflection current and samples the peak to peak excursions of the deflection current. The peak to peak voltage is the feedback voltage which is compared to an internal reference voltage. The result of the voltage comparison is a control voltage that affects the "B+" voltage for the horizontal output transformer. Such an approach was primarily designed to eliminate width variations due to small supply voltage variations. The feedback design tends to make the circuit unstable when large variations in horizontal frequency causes the deflection current to vary dramatically and therefore requiring large variations in "B+" voltage to maintain a constant width.

Figure 2B:
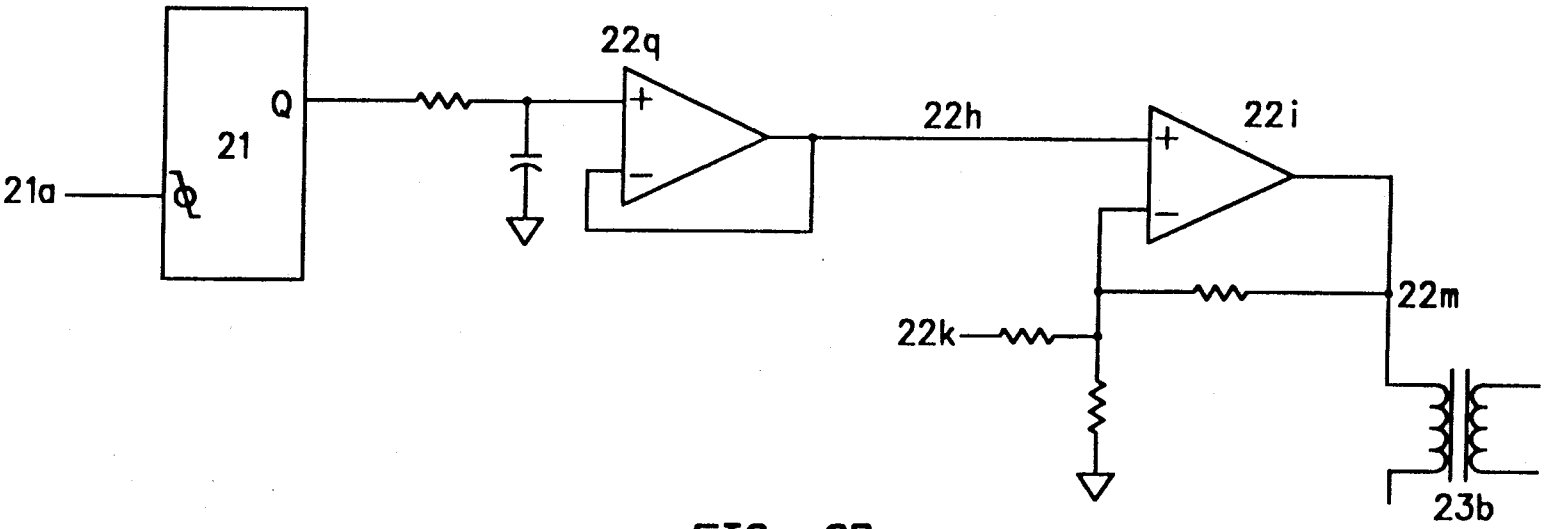
FIG. 2B details the frequency to voltage converter circuit portion of the horizontal deflection system part of the invention.

The approach used in the invention relies on a frequency to voltage onverter rather than a feedback circuit to control the "B+" voltage and is therefore much more stable in a mulstiscan environment. FIG. 2B details the frequency to voltage regulation circuit that tracks the horizontal scan frequency and adjusts the "B+" 22*m* voltage for the horizontal output transformer 23*b*. This circuit consists of two basic blocks: 1) a frequency to voltage converter made of non-retriggerable multi-vibrator 21*b* and low pass filter 22*g* and 2) a power amplifier 22*i*. The frequency to voltage converter produces a voltage 22*h* that is proportional to the incoming horizontal scan rate. This voltage 22*h* modulates power amplifier 22*i* producing the "B+" voltage 22*m*. This voltage may be trimmed by applying a trimming voltage into voltage node 22*k*.

Figure 7:
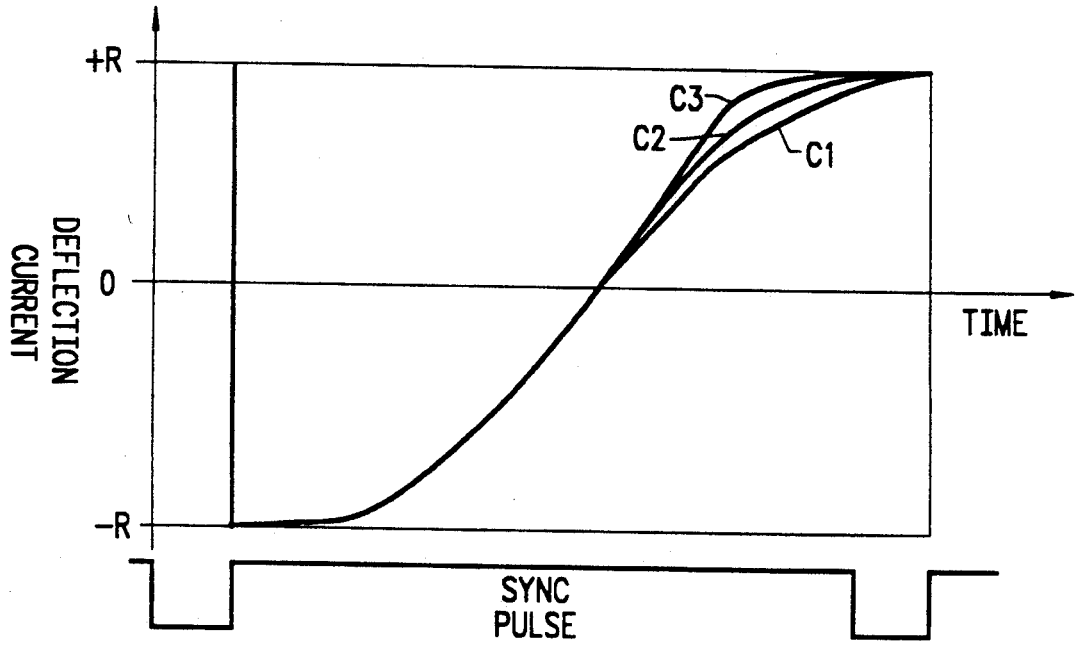
FIG. 7 illustrates variations in "S" bending of the current waveform supplied to the horizontal deflection coils from variations in horizontal sync frequency in an non-compensated horizontal deflection circuit.

In FIG. 7 is shown a plot of the deflection current versus time passing through the horizontal windings of the deflection coil of a flat face CRT for three different repetition rates of the horizontal sync pulses in a traditional system. The bending at the shoulder and toe of the plot, reflect the slowing of the deflection beam required to compensate for the increased distance the beam has to travel at the edges in a flat face CRT. A less than proportional increase of current with time at the toe and shoulder regions results in lower beams speeds at the left and right edge of the CRT.

Figure 8A:
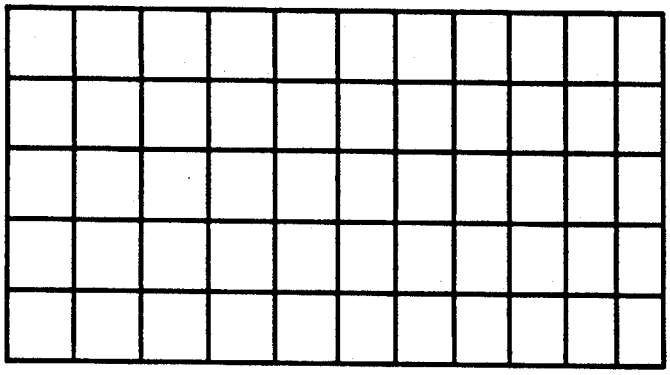
FIG. 8A illustrates the right side compression effect on an image displayed on a CRT caused by a decrease in horizontal frequency in a non-compensated horizontal deflection circuit.
Figure 8B:
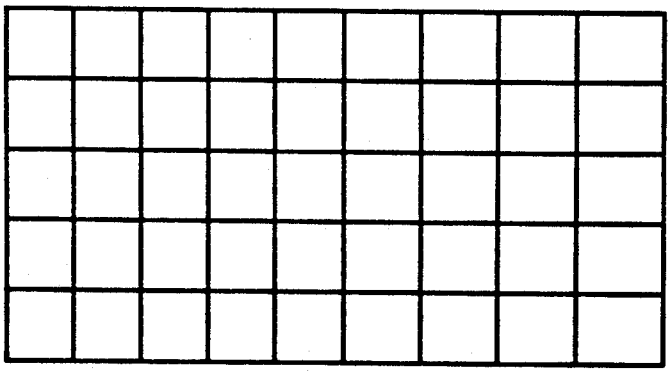
FIG. 8B illustrates the right side stretch effect on an image displayed on a CRT caused by an increase in horizontal frequency in a non-compensated horizontal deflection circuit.

A correct display of a linear grid corresponds to plot C2. A decrease in the repetition rate in a traditional system results in excessive "S" shaping in the shoulder region as in plot C3 causing right side compression of the scan as shown in FIG. 8A. An increase in the repetition rate in a traditional system results in insufficient "S" shaping in the shoulder region causing right side stretch of the scan as in FIG. 8B.

Current approaches to horizontal linearity compensation have used a damped series-resonant circuit. Such a circuit includes an "S" shaping capacitor and a linearity inductor in series with the horizontal deflection coil and produces a damped sine-wave of current which effectively adds to and subtracts from the yoke current and corrects for any non-linearity. The inductance in such a circuit will vary in a non-linear fashion with variations in horizontal repetition rates, generally requiring changes in values of the "S" shaping capacitor and linearity inductor.

Figures 1, 2C:
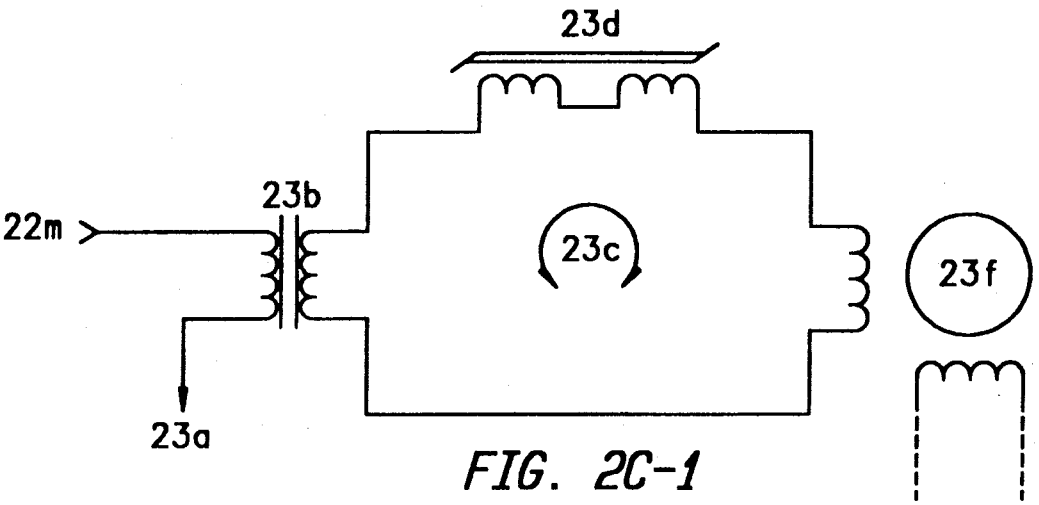
Figures 2, 2C:
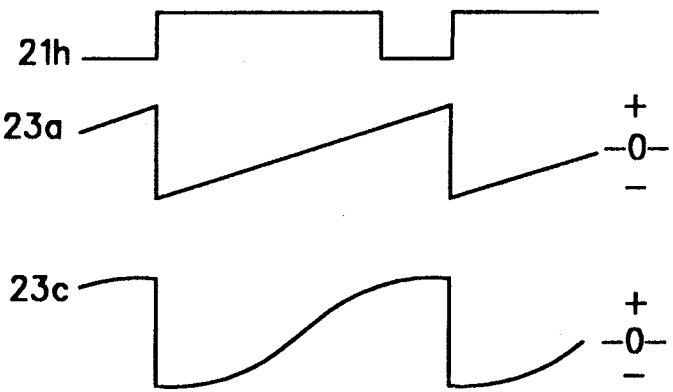

Linearity compensation circuit detailed in FIG. 2C-1 describes a strictly inductive approach to maintaining a horizontally linear scan and compensating for variations in horizontal scan frequency. The waveforms associated with FIG. 2C-1 are shown in FIG. 2C-2. A linear sawtooth current 23*a* is generated in primary winding of horizontal output transformer 23*b*. Inductor 23*d* is a dual magnetically biased coil designed to produce an impedance proportional to the amount of horizontal yoke current 23*c* regardless of the polarity of this current. The action of this linearity coil and horizontal coil of deflection yoke 23*f* is a gradual reduction of the horizontal scan at both ends of the scan ramp current. The amount of current reduction remains the same for any point along the scan as the horizontal timing varies.

I claim:

1. An inductive raster scan system for producing a display on a flat face CRT suitable for photographing where the display includes control by horizontal timing signals including horizontal sync pulses having an incoming scan rate, said system comprising horizontal deflection means for generating a system trigger pulse to provide a raster of constant width and horizontal linearity to be displayed on said CRT regardless of the timing of said horizontal timing signals, said horizontal deflection means including a digital filtering circuit including dual non-retriggerable multivibrator devices and a low pass filter for detecting the leading edge of said horizontal sync pulses and for filtering out serration and equalizing pulses from said horizontal timing signals so as to produce said system trigger pulse having an onset in constant pulse relation to the onset of said leading edge of said horizontal sync pulses regardless of any of said serration and equalizing pulses, a power amplifier, a frequency to voltage converter for providing a voltage for said power amplifier which is proportional to the incoming scan rate, means for maintaining said constant width that may also be trimmed by manual control, a bipolar inductor, said power amplifier including means for driving said bipolar inductor to maintain a constant frequency to impedance ratio throughout the horizontal scan frequency range.

2. In a raster scan system having a horizontal deflection coil for displaying an image on a flat face CRT where the horizontal deflection is controlled by repetitive horizontal timing signals, an inductive horizontal deflection circuit having an output stage, said inductive horizontal deflection circuit comprising:

means for automatically adjusting total inductance in said output stage with variations of said horizontal timing signals, said horizontal deflection circuit operating over a variable range of frequencies and includes bipolar inductor means for generating a sawtooth current waveform of constant peak amplitude and "S" bending regardless of the timing of said horizontal timing signals, said bipolar inductor means including means for applying said current waveform to the horizontal windings of said deflection coil.

3. A system as in claim 2 comprising a horizontal sync pulse and means for detecting the leading edge of the horizontal sync pulse.

4. A system as in claim 3 wherein the means for detecting the leading edge of the horizontal sync pulse comprises dual non-retriggerable multi-vibrator devices.

5. A system as in claim 2 further comprising means for converting the horizontal timing signals into a control voltage and means responsive to said control voltage for determining the width of the scan.

6. In a raster scan system having a horizontal deflection coil for displaying an image on a flat face CRT where the horizontal deflection is controlled by repetitive horizontal timing signals, an inductive horizontal deflection circuit having an output stage, said inductive horizontal deflection circuit comprising:

means for automatically adjusting total inductance in said output stage with variations of said horizontal timing signals, said horizontal deflection circuit operating over a variable range of frequencies and includes bipolar inductor means for generating a sawtooth current waveform of constant peak amplitude and "S" bending regardless of the timing of said horizontal timing signals, said bipolar inductor means including means for applying said current waveform to the horizontal windings of said deflection coil, and means for maintaining a constant ratio between the frequency of the horizontal sync pulses and the impedance in the horizontal deflection circuit.

7. A system as in claim 6 wherein the means for maintaining a constant ratio between the frequency of the horizontal sync pulses and the impedance in the horizontal deflection circuit comprises a secondary winding on the horizontal output transformer.

8. A raster scan system for producing a display on a flat face CRT of constant width and horizontal linearity, having horizontal deflection means, including an output stage, a horizontal output transformer and a horizontal deflection coil, where the horizontal deflection is controlled by repetitive timing signals, the method comprising the steps of automatically adjusting inductance in said output stage with variations of said horizontal timing signals, said step of automatically adjusting inductance including extracting the true horizontal sync pulses from the horizontal timing signals, converting the sync pulses to a voltage proportional to the frequency of said sync pulses, modulating the output drive of the horizontal deflection means by said voltage to obtain a current waveform of constant peak amplitude, passing that current waveform of constant peak amplitude through the primary winding of the horizontal output transformer, generating by transformer coupling a current waveform of constant peak amplitude and constant "S" bending, passing that current waveform of constant amplitude and "S" bending through the horizontal windings of the deflection coil to provide said display of constant width and horizontal linearity regardless of the timing of said horizontal timing signals.

* * * * *